US011631556B2

(12) United States Patent
Chou

(10) Patent No.: US 11,631,556 B2
(45) Date of Patent: Apr. 18, 2023

(54) ROLLING-BALL TILT SWITCH

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 0 days.

(21) Appl. No.: 17/829,667

(22) Filed: Jun. 1, 2022

(65) Prior Publication Data

US 2023/0028369 A1 Jan. 26, 2023

(30) Foreign Application Priority Data

Jul. 15, 2021 (TW) ..... 110126088

(51) Int. Cl.
*H01H 21/22* (2006.01)
*H01H 21/04* (2006.01)

(52) U.S. Cl.
CPC ..... *H01H 21/22* (2013.01); *H01H 21/04* (2013.01)

(58) Field of Classification Search
CPC ..... H01H 21/22; H01H 21/04; H01H 1/16; H01H 35/02; H01H 35/025; H01H 35/14; H01H 35/141
USPC ..... 200/239, 52 R, 61.11, 61.45 R–61.45 M
See application file for complete search history.

(56) References Cited

U.S. PATENT DOCUMENTS

2014/0231629 A1* 8/2014 Chou ..... G01C 9/10 250/214 SW
2014/0262704 A1* 9/2014 Chou ..... H01H 35/02 200/61.52

FOREIGN PATENT DOCUMENTS

CN 202167411 U 3/2012
TW I390563 B 3/2013

OTHER PUBLICATIONS

Search Report appended to an Office Action, which was issued to Taiwanese counterpart application No. 110126088 by the TIPO dated Apr. 20, 2022 with an English translation thereof.

* cited by examiner

*Primary Examiner* — Edwin A. Leon
*Assistant Examiner* — Iman Malakooti

(57) ABSTRACT

A rolling-ball tilt switch includes a conductive housing having an inner surface that surrounds a longitudinal axis and that defines a roller cavity, an insulating seat inserted into the roller cavity, a conductive terminal having a protruding section extending through the insulating seat into the roller cavity, and a conductive rolling-ball disposed in the roller cavity and movable between a conducting position and a non-conducting position. The longitudinal axis and an extension of a surface portion of the inner surface of the conductive housing cooperatively define an angle ranging from 5 to 55 degrees.

8 Claims, 9 Drawing Sheets

ROLLING-BALL TILT SWITCH

CROSS-REFERENCE TO RELATED APPLICATION

This application claims priority to Taiwanese Invention Patent Application No. 110126088, filed on Jul. 15, 2021.

FIELD

The disclosure relates to a tilt switch, and more particularly to a rolling-ball tilt switch.

BACKGROUND

Referring to FIG. 1, Taiwanese Invention Patent No. TWI390563B discloses a conventional rolling-ball tilt switch 9 including a conductive shell 91, two rolling-balls 92, an insulating seat 93 and a conductive terminal 94. The conductive shell 91 has an outer surface 911 surrounding a central axis (C), and an inner surface 913 surrounding the central axis (C) and defining a reception space 912, a rim surface 914 interconnecting the inner surface 913 and the outer surface 911 and defining an opening 916 which communicates with the reception space 912, and an enclosed part 915 opposite to the rim surface 912 along the central axis (C) and connected between the inner surface 913 and the outer surface 911. The two rolling-balls 92 are electrically conductive, and are disposed in the reception space 912 and contained therein. The insulating seat 93 is installed on the conductive shell 91 so that the two rolling-balls 92 are contained within the reception space 912. The conductive terminal 94 extends through the insulating seat 93 along the central axis (C) so as to cooperate with the insulating seat 93 to block the opening 916, and a tip of the conductive terminal 94 protrudes into the reception space 912. When the conventional rolling-ball tilt switch 9 is tilted, as long as any one of the two rolling-balls 92 are concurrently in contact with the conductive shell 91 and the conductive terminal 94, the conventional rolling-ball tilt switch 9 is in a conducting state. However, if the conventional rolling-ball tilt switch 9 is slightly tilted so that there is a small change in the tilt angle, the rolling-balls 92 will move, and the conventional rolling-ball tilt switch 9 may switch from the conducting state to a non-conducting state, where both the two rolling-balls 92 are separated from the conductive terminal 94. Therefore, the conventional rolling-ball tilt switch is susceptible to small angle adjustments and cannot remain in the conducting state within a designated range of tilt angles.

SUMMARY

Therefore, an object of the disclosure is to provide a rolling-ball tilt switch that can remain in a conducting state under a range of tilt angles.

According to the disclosure, the rolling-ball tilt switch is adapted to be electrically connected to a circuit board that is on a reference surface. The rolling-ball tilt switch includes a conductive housing, an insulating seat, a conductive terminal, and a conductive rolling-ball. The conductive housing is adapted to be secured to the circuit board, and has an inner surface, an outer surface, a rim end surface, and a distal end surface. The inner surface is adapted to surround a longitudinal axis perpendicular to the circuit board, and defines a roller cavity. The outer surface surrounds and is opposite to the inner surface. The rim end surface interconnects the inner surface and the outer surface. The distal end surface interconnects the inner surface and the outer surface, and is opposite to the rim end surface along the longitudinal axis.

The inner surface has a first surface portion, a second surface portion, a third surface portion, and a fourth surface portion. The first surface portion is proximate to the rim end surface. The second surface portion is connected to the first surface portion, extends from the first surface portion along the longitudinal axis towards the distal end surface, and diverges away from the longitudinal axis. The third surface portion extends from the second surface portion along the longitudinal axis towards the distal end surface. The fourth surface portion extends from the third surface portion along the longitudinal axis towards the distal end surface and converges towards the longitudinal axis.

The longitudinal axis and an extension of the second surface portion of the inner surface cooperatively defines a first angle that ranges from 5 to 55 degrees. The insulating seat is adjacent to the rim end surface and is fittingly inserted into the roller cavity.

The conductive terminal has a protruding section extending through the insulating seat into the roller cavity and cooperating with the insulating seat to seal an end of the roller cavity adjacent to the rim end surface. The conductive rolling-ball is disposed in the roller cavity, and is movable between a conducting position, where the conductive rolling-ball is concurrently in contact with the protruding section of the conductive terminal and the second surface portion, and a non-conducting position, where the conductive rolling-ball is separated from the protruding section of the conductive terminal.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
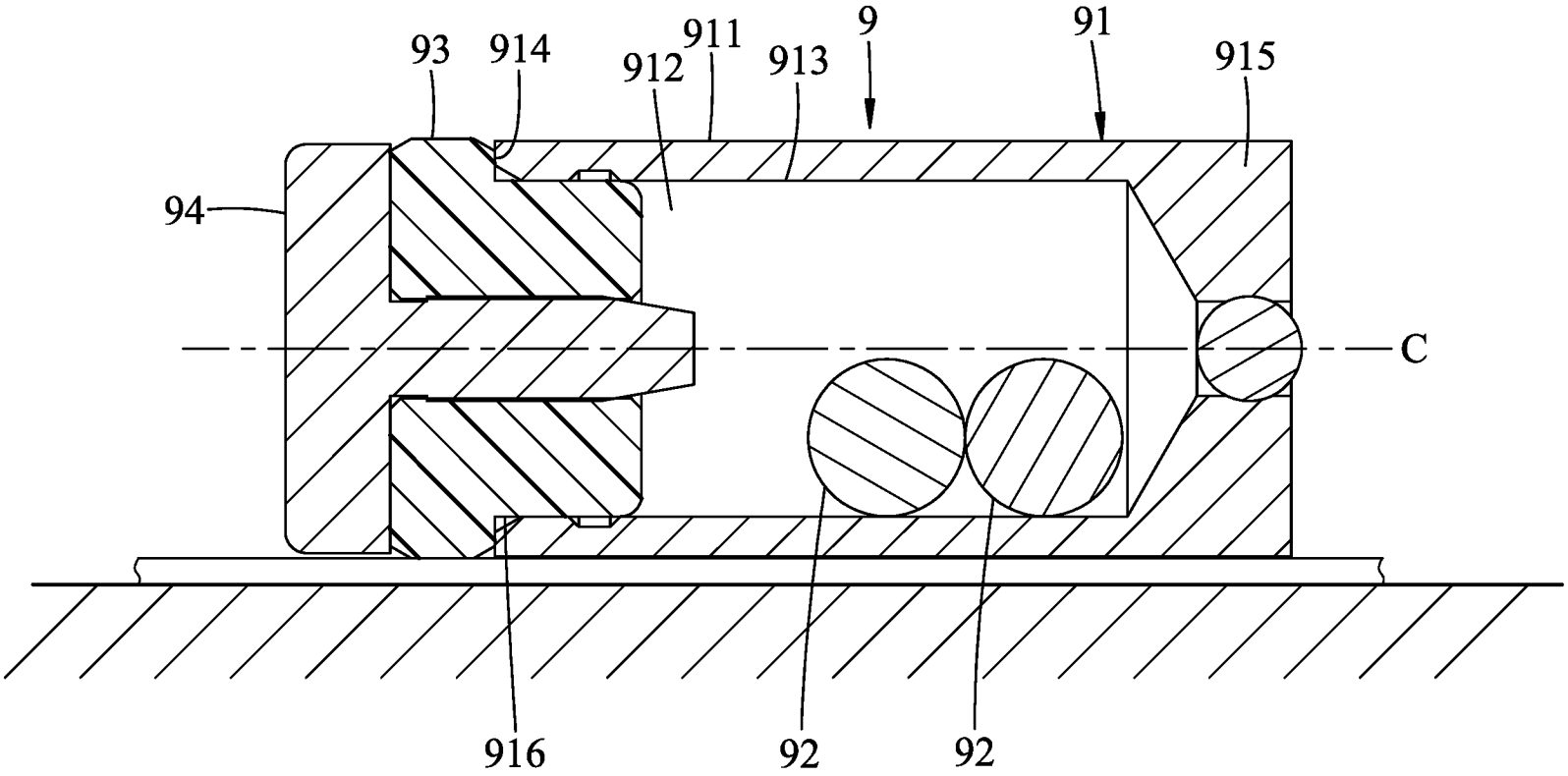
FIG. 1 PRIOR ART
FIG. 1 is a sectional view of a conventional rolling-ball tilt switch disclosed in Taiwanese Invention Patent No. TWI390563B.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
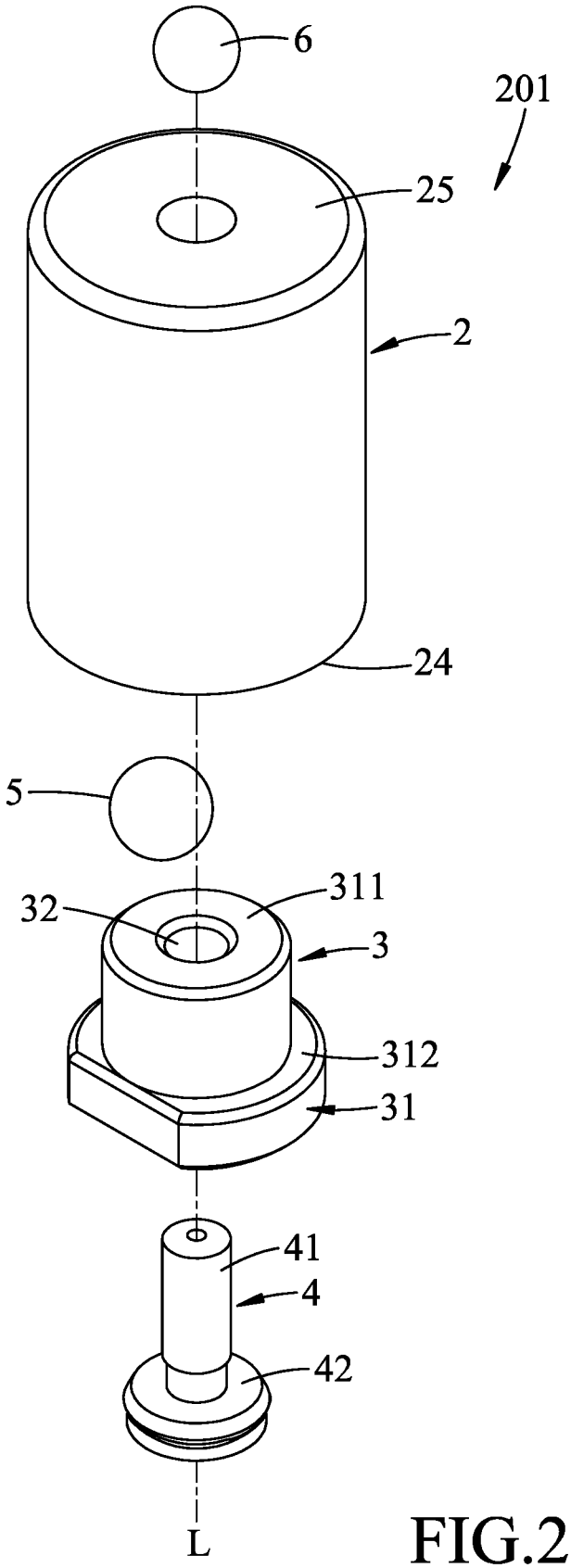
FIG. 2 is an exploded perspective view illustrating a first embodiment of a rolling-ball tilt switch according to this disclosure.
Figure 3:
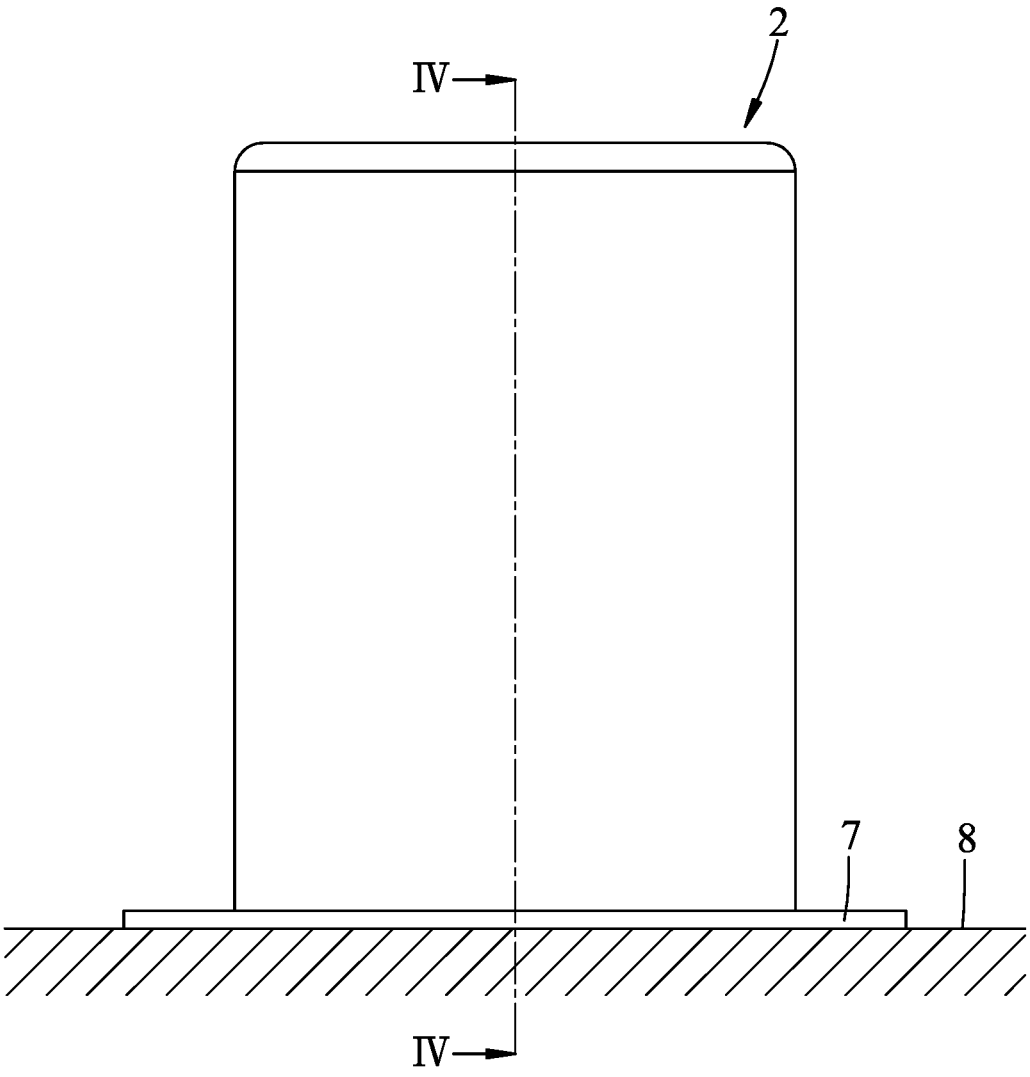
FIG. 3 is a side view of the first embodiment.
Figure 4:
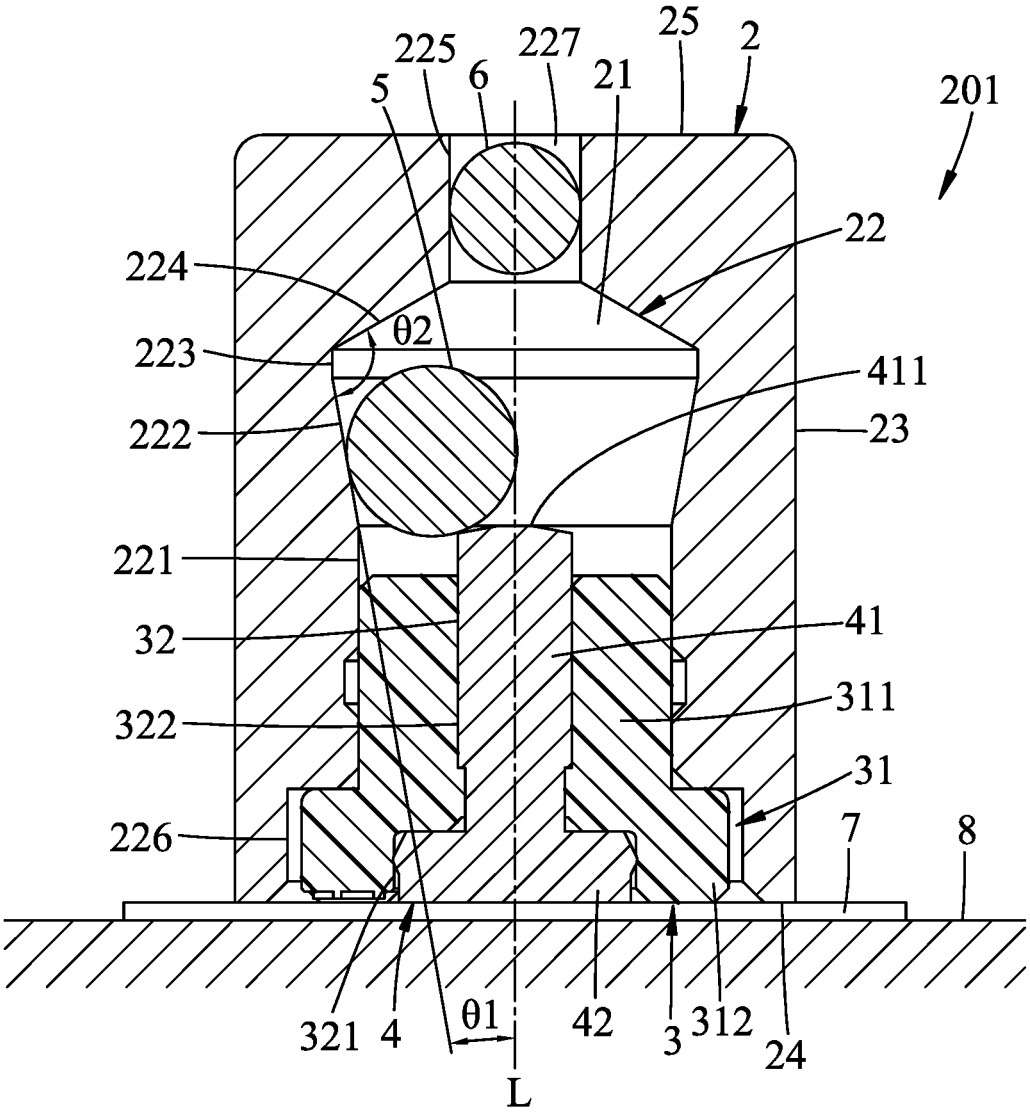
FIG. 4 is a sectional view taken along line IV-IV in FIG. 3, illustrating the first embodiment of the rolling-ball tilt switch in a conducting position.

Referring to FIGS. 2 to 4, a first embodiment of the rolling-ball tilt switch 201 according to the present disclosure is shown, and it is adapted to be electrically connected to a circuit board 7 that is on a reference surface 8. The rolling-ball tilt switch 201 includes a conductive housing 2, an insulating seat 3, a conductive terminal 4, a conductive rolling-ball 5, and a plugging sphere 6.

The conductive housing 2 is adapted to be secured to the circuit board 7, and has an inner surface 22, and outer surface 23, a rim end surface 24, and a distal end surface 25. The inner surface 22 is adapted to surround a longitudinal axis (L) perpendicular to the circuit board 7, and defines a roller cavity 21. The outer surface 23 surrounds and is opposite to the inner surface 22. The rim end surface 24 surrounds the longitudinal axis (L) and interconnects the inner surface 22 and the outer surface 23. The distal end surface 25 surrounds the longitudinal axis (L), interconnects the inner surface 22 and the outer surface 23, and is opposite to the rim end surface 24 along the longitudinal axis (L).

The inner surface 22 has a first surface portion 221, a second surface portion 222, a third surface portion 223, and a fourth surface portion 224. The first surface portion 221 is proximate to the rim end surface 24 and is cylindrical. The second surface portion 222 is connected to the first surface portion 221, extends from the first surface portion 221 along the longitudinal axis (L) toward the distal end surface 25, and diverges away from the longitudinal axis (L) (i.e., the part of the roller cavity 21 surrounded by the second surface portion 222 has a diameter that increases along the longitudinal axis (L) towards the distal end surface 25). The third surface portion 223 extends from the second surface portion 222 along the longitudinal axis (L) towards the distal end surface 25, and is cylindrical. The fourth surface portion 224 extends from the third surface portion 223 along the longitudinal axis (L) towards the distal end surface 25 and converges towards the longitudinal axis (L) (i.e., the part of the roller cavity 21 surrounded by the fourth surface portion 224 has a diameter that decreases along the longitudinal axis (L) towards the distal end surface 25).

The longitudinal axis (L) and an extension of the second surface portion 222 of the inner surface 22 cooperatively define a first angle (θ1) that ranges from 5 to 55 degrees.

The inner surface 22 further has a fifth surface portion 225 and a sixth surface portion 226. The fifth surface portion 225 extends from the fourth surface portion 224 along the longitudinal axis (L) to the distal end surface 25, and defines an oculus 227. The sixth surface portion 226 is connected to the first surface portion 221, is disposed between the rim end surface 24 and the first surface portion 221, is cylindrical, and has a diameter that is larger than a diameter of the first surface portion 221.

The insulating unit 3 is adjacent to the rim end surface 24 and fittingly inserted into the roller cavity 21. The insulating unit 3 has a base body 31 that surrounds the longitudinal axis (L), and an insertion hole 32 that extends along the longitudinal axis (L) through the base body 31. The base body 31 has an annular plug section 311 that is inserted into the roller cavity 21 and that abuts against the first surface portion 221 of the inner surface 22, and an annular sealing section 312 that is connected to the annular plug section 311, that has a diameter larger than that of the annular plug section 311, and that is surrounded by the sixth surface portion 226 of the inner surface 22. The insertion hole 32 of the insulating base 3 is a stepped hole, and has a large hole section 321 that is formed in the annular sealing section 312 of the base body 31, and a small hole section 322 that has a diameter smaller than a diameter of the large hole section 321, and that extends from the large hole section 321, through the annular plug section 311 of the base body 31, into the roller cavity 21.

The conductive terminal 4 has a protruding section 41 that extends through the insulating seat 3 into the roller cavity 21, and a terminal head 42 that is fittingly inserted into the large hole section 321 of the insertion hole 32, and that has a diameter larger than that of the protruding section 41. The protruding section 41 extends from the terminal head 42 into the roller cavity 21. The conductive terminal 4 cooperates with the insulating seat 3 to seal an end of the roller cavity 21 adjacent to the rim end surface 24.

The conductive rolling-ball 5 is disposed in the roller cavity 21, and is movable between a conducting position (see FIG. 4), where the conductive rolling-ball 5 is concurrently in contact with the protruding section 41 of the conductive terminal 4 and the second surface portion 222, and a non-conducting position (see FIG. 5), where the conductive rolling-ball 5 is separated from the protruding section 41 of the conductive terminal 4.

During manufacturing of the rolling-ball tilt switch 201, an electroplating process is used on the rolling-ball tilt switch 201. The oculus 227 prevents electroplating solution from accumulating in the conductive housing 2 by providing an outlet for the electroplating solution to drain out. The plugging sphere 6 is disposed in the oculus 227 and seals the oculus 227 after the electroplating process.

In this embodiment, the rolling-ball tilt switch 201 has the conductive terminal 4 cooperating with the insulating seat 3 to seal one end of the roller cavity 21, and the plugging sphere 6 to seal the oculus 227, thereby sealing the opposite end of the roller cavity 21. This creates an airtight and watertight seal so that the roller cavity 21 of the conductive housing 2 is isolated from the external environment, and the conductive rolling-ball 5 therein can be protected from corrosion and rust.

Figure 5:
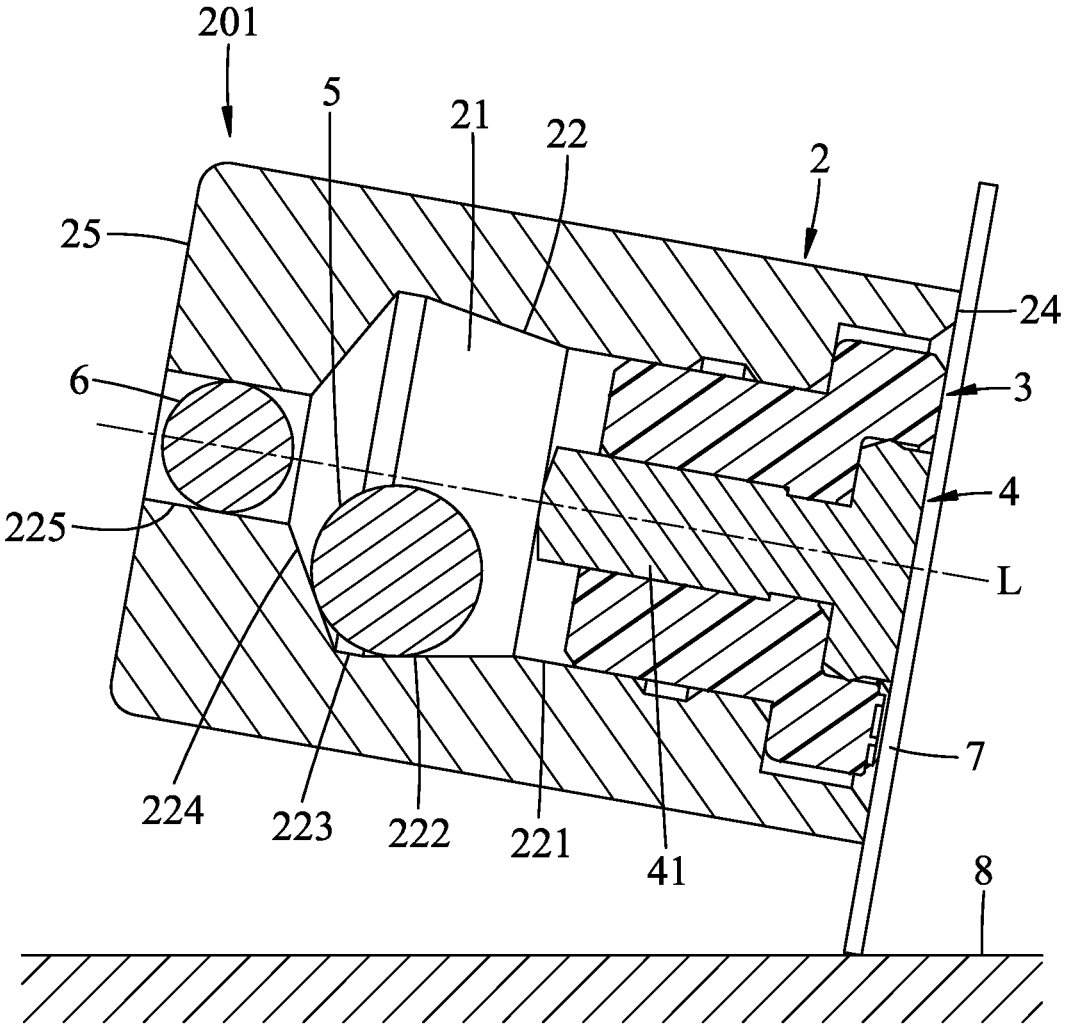
FIG. 5 is a sectional view illustrating the first embodiment in a non-conducting position.

Referring to FIGS. 4 and 5, when in use the rolling-ball tilt switch 201 is electrically connected to the circuit board 7 and placed on the reference surface 8. When the rolling-ball tilt switch 201 is placed in a state where the longitudinal axis (L) is perpendicular to the reference surface 8, the conductive rolling-ball 5 is in the conducting position. When the rolling-ball tilt switch 201 is tilted to another state where the longitudinal axis (L) deviates from being perpendicular to the reference surface 8 by an angle that is more than 80 degrees (see FIG. 5), the conductive rolling-ball 5 will then move to the non-conducting position to be separated from the protruding section 41 of the conductive terminal 4.

In the first embodiment, the first angle (θ1) is substantially 10 degrees, therefore, when the rolling-ball tilt switch 201 is placed so that the longitudinal axis (L) deviates from being perpendicular to the reference surface 8 by less than 80 degrees, the conductive rolling-ball 5 will remain to be in the conducting position, and the rolling-ball tilt-switch 201 will remain in a conducting state. Conversely, when rolling-ball tilt switch 201 is placed so that the longitudinal axis (L) deviates from being perpendicular to the reference surface 8 by more than 80 degrees, the conductive rolling-ball 5 will then move to the non-conducting position, and the rolling-ball tilt-switch 201 will switch to a non-conducting state. Therefore, the rolling-ball tilt switch 201 is able to remain in the conducting state over the range of the designated tilt angles and the object of this disclosure is satisfied.

In this embodiment, an extension of the second surface portion 222 and an extension of the fourth surface portion 224 intersect and define a second angle (θ2) that ranges from 100 to 120 degrees. The angle (θ2) being within this designated range is useful for preventing the conductive rolling-ball 5 from getting stuck between the second surface portion 222 and the fourth surface portion 224, and causing the rolling-ball 5 to be unable to successfully transition from the non-conducting position to the conducting position. In an exemplary case the angle (θ2) is preferably 110 degrees.

Figure 6:
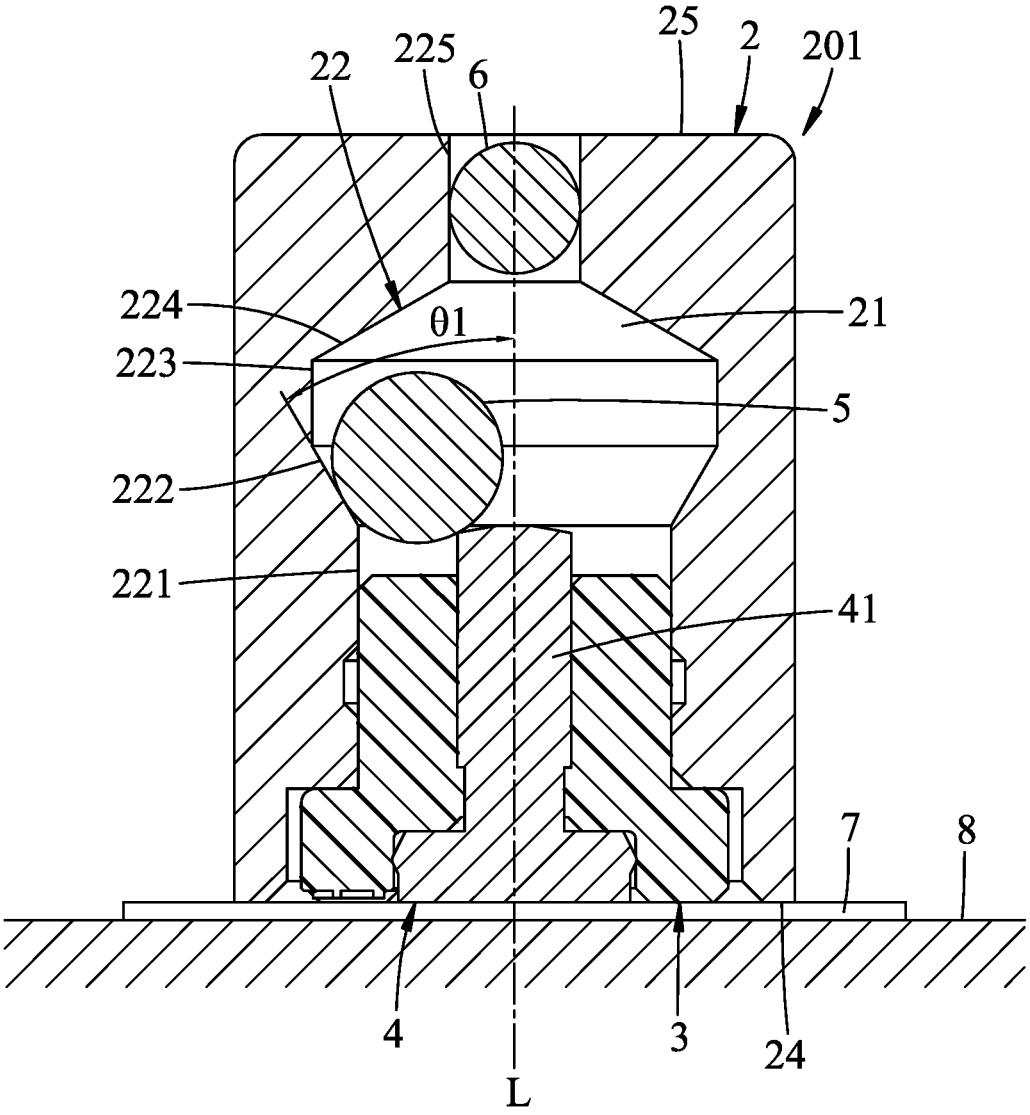
FIG. 6 is a sectional view illustrating a second embodiment of the rolling-ball tilt switch according to this disclosure in a conducting position.
Figure 7:
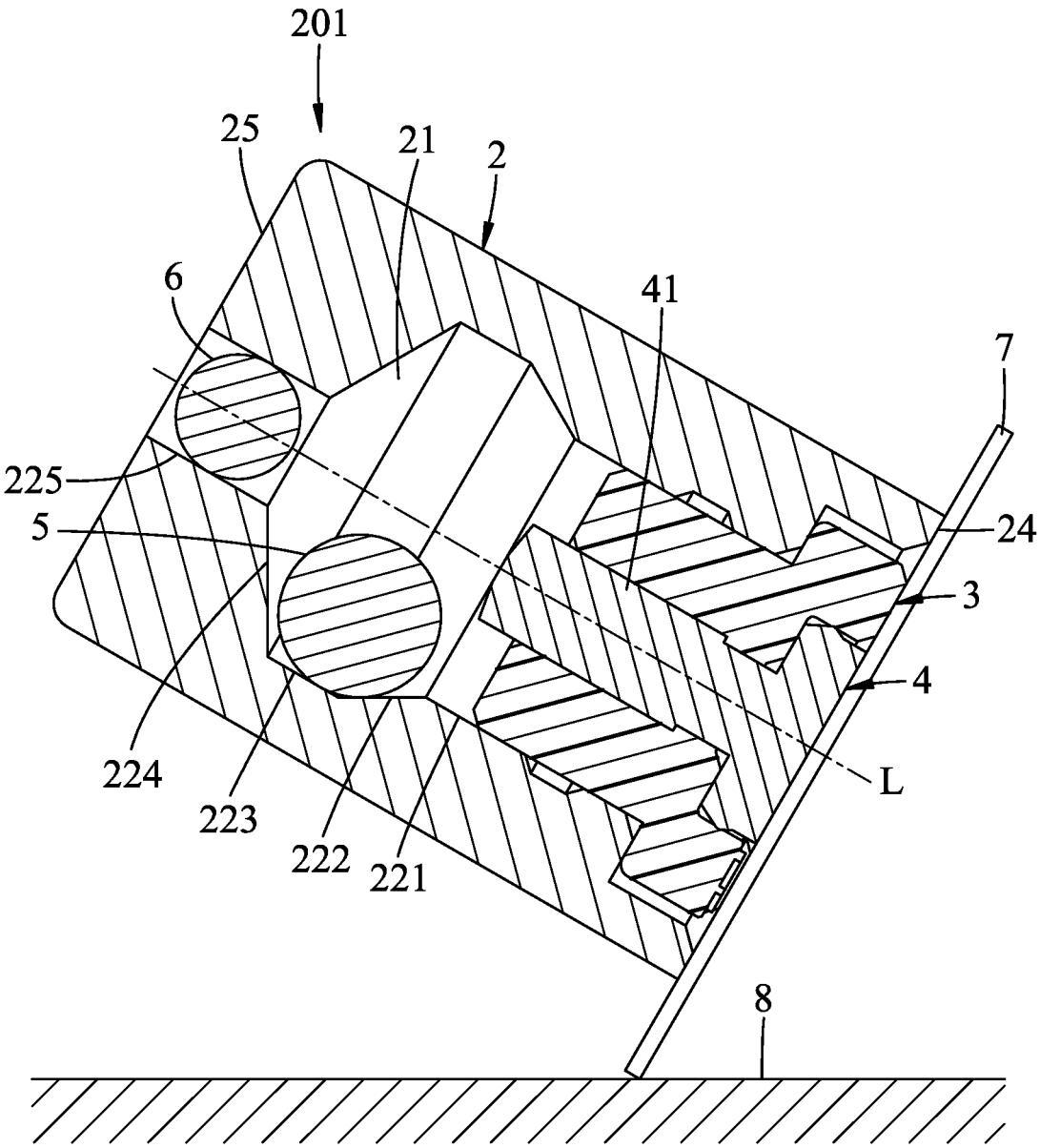
FIG. 7 is a sectional view illustrating the second embodiment in a non-conducting position.

Referring to FIGS. 6 and 7, a second embodiment of the rolling-ball tilt switch 201 according to the present disclosure is shown. The second embodiment is similar to the first embodiment, and the main difference resides in the following.

In the second embodiment, the first angle (θ1) defined between the extension of the longitudinal axis (L) and the extension of the second surface portion 222 of the inner surface 22 is substantially 30 degrees. When the rolling-ball tilt switch 201 is placed in the state where the longitudinal axis (L) is perpendicular to the reference surface 8, the conductive rolling-ball 5 is in the conducting position, and the rolling-ball tilt switch 201 is in the conducting state. When the rolling-ball tilt switch 201 is placed so that the longitudinal axis (L) deviates from being perpendicular to the reference surface 8 by less than 60 degrees, the conductive rolling-ball 5 will remain to be in the conducting position, and the rolling-ball tilt-switch 201 will remain in the conducting state. When the rolling-ball tilt switch 201 is placed in another state where the longitudinal axis (L) is tilted to deviate from being perpendicular to the reference surface 8 by an angle that is more than 60 degrees, the conductive rolling-ball (5) is in the non-conducting position, and the rolling-ball tilt switch 201 is in the non-conducting state.

Therefore, the second embodiment has the same advantage as that of the first embodiment.

Figure 8:
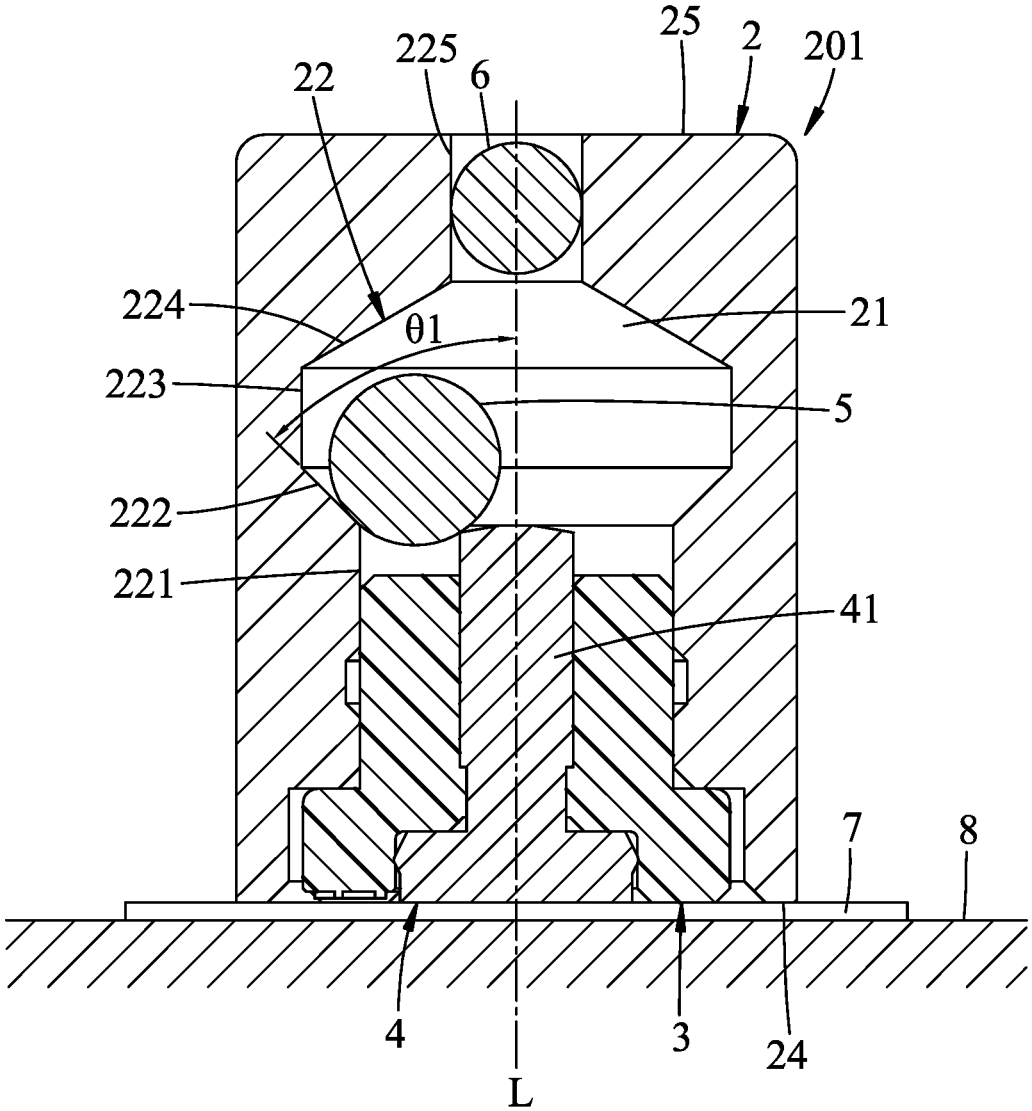
FIG. 8 is a sectional view illustrating a third embodiment of the rolling-ball tilt switch according to this disclosure in the conducting position.
Figure 9:
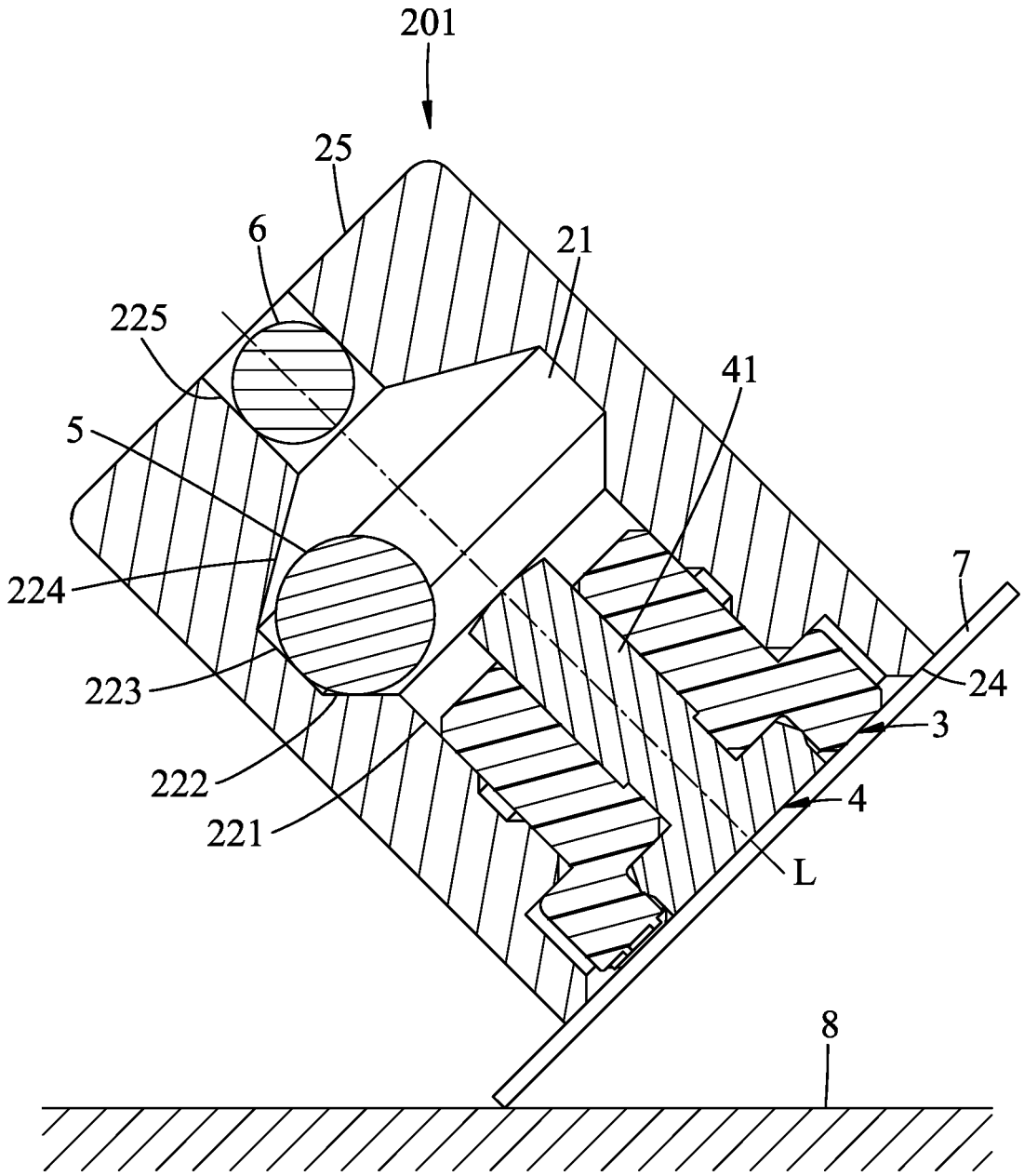
FIG. 9 is a sectional view showing the third embodiment in the non-conducting position.

Referring to FIGS. 8 and 9, a third embodiment of the rolling-ball tilt switch 201 is also similar to the first embodiment, and the main difference resides in the following.

In the third embodiment, the first angle (θ1) defined between the extension of the longitudinal axis (L) and the extension of the second surface portion 222 of the inner surface 22 is substantially 45 degrees. When the rolling-ball tilt switch 201 is placed in the state where the longitudinal axis (L) is perpendicular to the reference surface 8, the conductive rolling-ball 5 is in the conducting position causing the rolling-ball tilt switch 201 to be in the conducting state. When the rolling-ball tilt switch 201 is placed so that the longitudinal axis (L) deviates from being perpendicular to the reference surface 8 by less than 45 degrees, the conductive rolling-ball 5 will remain to be in the conducting position, and the rolling-ball tilt-switch 201 will remain in the conducting state. When the rolling-ball tilt switch 201 is placed in another state where the longitudinal axis (L) is tilted to deviate from being perpendicular to the reference surface 8 by an angle that is more than 45 degrees, the conductive rolling-ball 5 is in the non-conducting position and the rolling-ball tilt switch 201 is in the non-conducting state.

Therefore, the third embodiment has the same advantage as that of the first embodiment.

In summary of the above, by virtue of designating the first angle (θ1) defined between the extension of the longitudinal axis (L) and the extension of the second surface portion 222 of the inner surface 22 in the first, second and third embodiments of the rolling-ball tilt switch 201, each of these embodiments can remain in the conducting position under its designated range of tilt angles that may be suitable for different applications of the rolling-ball tilt switch 201.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A rolling-ball tilt switch adapted to be electrically connected to a circuit board that is on a reference surface, said rolling-ball tilt switch comprising:

a conductive housing adapted to be secured to the circuit board, and having an inner surface that is adapted to surround a longitudinal axis perpendicular to the circuit boar, and that defines a roller cavity, an outer surface that surrounds and is opposite to said inner surface, a rim end surface that interconnects said inner surface and said outer surface, and a distal end surface that interconnects said inner surface and said outer surface, and that is opposite to said rim end surface along the longitudinal axis, said inner surface having a first surface portion that is proximate to said rim end surface, a second surface portion that is connected to said first surface portion, that extends from said first surface portion along the longitudinal axis towards said distal end surface, and that diverges away from the longitudinal axis, a third surface portion that extends from said second surface portion along the longitudinal axis towards said distal end surface, and a fourth surface portion that extends from said third surface portion along the longitudinal axis towards said distal end surface and that converges towards the longitudinal axis, the longitudinal axis and an extension of said second surface portion of said inner surface cooperatively defining a first angle that ranges from 5 to 55 degrees;

an insulating seat being adjacent to said rim end surface and fittingly inserted into said roller cavity;

a conductive terminal having a protruding section extending through said insulating seat into said roller cavity and cooperating with said insulating seat to seal an end of said roller cavity adjacent to said rim end surface; and a conductive rolling-ball disposed in said roller cavity, and movable between a conducting position, where said conductive rolling-ball is concurrently in contact with said protruding section of said conductive terminal and said second surface portion, and a non-conducting position, where said conductive rolling-ball is separated from said protruding section of said conductive terminal.

2. The rolling-ball tilt switch as claimed in claim 1, wherein:

said first angle is substantially degrees;

when said rolling-ball tilt switch is placed in a state where the longitudinal axis is perpendicular to the reference surface, said conductive rolling-ball is in the conducting position; and when said rolling-ball tilt switch is placed in another state where the longitudinal axis is tilted to deviate from being perpendicular to the reference surface by an angle that is more than 80 degrees, said conductive rolling-ball is in the non-conducting position.

3. The rolling-ball tilt switch as claimed in claim 2, wherein an extension of said second surface portion and an extension of said fourth surface portion intersect and define a second angle that ranges from 100 to 120 degrees.

4. The rolling-ball tilt switch as claimed in claim 1, wherein:

said first angle is substantially 30 degrees;

when said rolling-ball tilt switch is placed in a state where the longitudinal axis is perpendicular to the reference surface, said conductive rolling-ball is in the conducting position;

when said rolling-ball tilt switch is placed in another state where the longitudinal axis is tilted to deviate from being perpendicular to the reference surface by an angle that is more than 60 degrees, said conductive rolling-ball is in the non-conducting position.

5. The rolling-ball tilt switch as claimed in claim 1, wherein:

said first angle is substantially 45 degrees;

when said rolling-ball tilt switch is placed in a state where the longitudinal axis is perpendicular to the reference surface, said conductive rolling-ball is in the conducting position; and when said rolling-ball tilt switch is placed in another state where the longitudinal axis is tilted to deviate from being perpendicular to the reference surface by an angle that is more than 45 degrees, said conductive rolling-ball is in the non-conducting position.

6. The rolling-ball tilt switch as claimed in claim 1, wherein:

said inner surface of said conductive housing further has a fifth surface portion that extends from the fourth surface portion along the longitudinal axis to said distal end surface, and that defines an oculus; and said rolling-ball tilt switch further comprises a plugging sphere that is disposed in said oculus and that seals said oculus and said roller cavity from the external environment.

7. The rolling-ball tilt switch as claimed in claim 1 wherein:

said inner surface of said conductive housing further has a sixth surface portion that is connected to said first surface portion, that is disposed between said rim end surface and said first surface portion, and that has a diameter larger than a diameter of said first surface portion;

said insulating unit has a base body that surrounds the longitudinal axis, and an insertion hole that extends along the longitudinal axis through said base body; and said base body has an annular plug section that is inserted into said roller cavity and that abuts against said first surface portion of said inner surface, and an annular sealing section that is connected to said annular plug section, that has a diameter larger than that of said annular plug section, and that is surrounded by said sixth surface portion.

8. The rolling-ball tilt switch as claimed in claim 7, wherein:

said insertion hole of said insulating base is a stepped hole, and has a large hole section that is formed in said annular sealing section of said base body, and a small hole section that has a diameter smaller than a diameter of said large hole section, and that extends from said large hole section, through said annular plug section of said base body, into said roller cavity;

said conductive terminal further has a terminal head that is fittingly inserted into said large hole section of said insertion hole, and that has a diameter larger than that of said protruding section; and said protruding section of said conductive terminal extends from said terminal head through said small hole section of said insertion hole into said roller cavity.

* * * * *